US006158152A

United States Patent [19]

Nathenson et al.

[11] Patent Number: 6,158,152

[45] Date of Patent: Dec. 12, 2000

[54] PNEUMATIC EXCAVATOR

[75] Inventors: Richard D. Nathenson; Jerome Apt, Jr., both of Pittsburgh; Paul M. Brumbaugh, Trafford; Martin J. Uram, Baldwin Boro, all of Pa.

[73] Assignee: Concept Engineering Group, Inc.

[21] Appl. No.: 09/381,018

[22] PCT Filed: Mar. 13, 1998

[86] PCT No.: PCT/US98/04968

§ 371 Date: Dec. 2, 1999

§ 102(e) Date: Dec. 2, 1999

[87] PCT Pub. No.: WO98/40568

PCT Pub. Date: Sep. 17, 1998

Related U.S. Application Data

[63] Continuation-in-part of application No. 08/816,430, Mar. 14, 1997, Pat. No. 5,966,847.

[60] Provisional application No. 60/013,410, Mar. 14, 1996.

[51] Int. Cl.[7] ..... E02F 5/02

[52] U.S. Cl. ..... 37/347; 239/532

[58] Field of Search ..... 37/322, 323, 347, 37/905; 171/1, 10, 17, 141; 239/99, 102.1, 290, 532, 587, DIG. 21, DIG. 22; 175/67; 405/262

[56] References Cited

U.S. PATENT DOCUMENTS

| | | | |
|---|---|---|---|
| 2,557,247 | 6/1951 | Ziherl . | |
| 3,645,450 | 2/1972 | Calder . | |
| 4,288,886 | 9/1981 | Siegler | 15/330 |
| 5,170,943 | 12/1992 | Artzberger | 239/532 |
| 5,195,208 | 3/1993 | Yamami et al. | 15/326 |
| 5,291,819 | 3/1994 | Hambric | 89/1.13 |

FOREIGN PATENT DOCUMENTS 0251660 1/1988 European Pat. Off. .

*Primary Examiner*—Robert E. Pezzuto

*Attorney, Agent, or Firm*—Webb Ziesenheim Logsdon Orkin & Hanson, P.C.

[57] ABSTRACT

A portable excavator having a tube to point a supersonic gas stream at a buried object. The excavator includes a movable member disposed within the conduit to pulse gas passing through the conduit and a supersonic gas nozzle at the exit of the conduit. Compressed gas delivered to the conduit exits the nozzle in a pulsed manner at two to three Hz. The movable member includes a piston which blocks gas from flowing through the conduit by the biasing force of a spring. When the force to the pressure differential across the piston exceeds the biasing force, the piston moves and allows gas to flow through the conduit until the force from the pressure differential across the piston is less than the biasing force.

23 Claims, 11 Drawing Sheets

PNEUMATIC EXCAVATOR

CROSS REFERENCE TO RELATED APPLICATION

This application claims priority to International Application No. PCT/US98/04968, filed Mar. 13, 1998, which is a continuation-in-part of U.S. patent application Ser. No. 08/816,430, filed Mar. 14, 1997 now U.S. Pat. No. 5,966,847, which claims the benefit of U.S. Provisional Patent Application Ser. No. 60/013,410, filed Mar. 14, 1996.

BACKGROUND OF THE INVENTION

1. Field of the Invention

This invention relates to excavators and, more particularly, to hand-held pneumatic excavators.

2. Description of the Prior Art

Since the 1960's, contractors have used compressed air exiting from the end of an open pipe for cleaning operations. Such uses include loosening soil from around buried water pipes, gas mains, electrical cables and the like in small hole excavations. Previously, picks, digging bars, spades, buckets or blades having hard cutting edges were used to uncover a buried object and often caused significant damage to the buried object. The use of compressed air has the advantage of pulverizing most soil types without damaging the buried object.

Pneumatic devices which use compressed air to uncover buried objects typically include a source of air under pressure, such as a compressor connected via a valve mechanism to an elongated tube. The valve mechanism controls the flow of compressed air through the tube.

However, compressed air exiting from the open end of a tube expands suddenly to atmosphere in an unfocused, complicated and wasteful manner. To improve performance of compressed air excavators, a nozzle is incorporated on the exit end of the tube. Typically, the nozzle has an inwardly converging upstream end which merges into a diverging downstream end. This configuration acts to reduce the pressure of the air or gas and increase its velocity. European Patent No. 0 251 660 describes a typical pneumatic hand tool based upon this design. U.S. Pat. No. 5,170,943 shows a similar high velocity pneumatic excavating hand tool having a valve connecting a pressurized gas supply to a non-conductive tube having a terminal nozzle.

However, little attention has been paid to the proper engineering design of the nozzle for excavation purposes. Excavation results appear to be empirically based; some prior art devices supposedly provide results which do not correspond to gas dynamic relations governing the performance of these nozzles. To achieve the air exit velocities cited in one of these latter devices, it would have to be supplied with compressed air at over two hundred psig (pounds per square inch gauge). This is well over double the one hundred psig normally used in the trade and generally available from a conventional portable air compressor. Previous devices, hence, have been energy inefficient and wasteful.

In addition, these prior art devices generate a large amount of dust and debris blowback at the operator during digging operations. This is due both to an over use of compressed air and the unfocused and highly dissipative nature of the nozzles. In an extreme case, standing shock waves may be formed downstream of the nozzle exit. These shock waves suddenly decelerate the air jet speed from supersonic to subsonic with concomitant loss of excavation ability.

Conventional portable air compressors which serve as the gas supply for prior art devices are constrained because the range of the effective working distances of the prior art devices is limited by the length of an air hose from the air compressor, generally no more than fifty to one hundred feet. Because conventional portable air compressors generally must be towed into position by other vehicles, they are limited to roadways and to areas adjacent to level or smooth areas capable of being traversed by vehicles. Farm lands, fields, water holes, forested or rocky areas are difficult to reach effectively in this manner.

Since the late 1970's, there has been considerable work towards developing small, inexpensive, portable, high flow air units. These are typically used to blow away leaves, grass clippings and the like from in front of an operator. U.S. Pat. No. 4,288,886 discloses an air broom system which includes a housing, a portable power unit, a rotary impeller unit and a tube from which air exits. U.S. Pat. No. 5,195,208 discloses a backpack power blower apparatus made up of a frame supporting an engine, a blower and associated parts, including sound insulation. Although these prior art devices can be carried on an operator's back and produce an airstream, none produces an airstream at a rate which is sufficient to excavate material more cohesive than loose sand. None of these prior art devices contains a compressor to generate such an airstream.

The ability to safely unearth a variety of buried objects is becoming increasingly important, especially in public and private remediation of hazardous waste sites. From the industrial and nuclear energy sector, such objects include glass bottles, cardboard or wooden boxes, metal or fiber drums and metal cylinders containing chemical or radioactive hazardous waste. Backhoes or hydraulic excavators are the most commonly used machines for such excavating. However, excavation using heavy machinery is slow because of the extra time and care required to maneuver around hazardous buried objects. Despite the care with which they might be used by a skilled operator, a risk exists that the hard cutting edges of heavy machinery may cause significant damage to the buried object. Government and industry are beginning to mandate only hand digging in an area with suspected buried objects. Hand digging is slow, fatiguing and costly in both direct manpower and idling of heavy excavating machinery.

Buried objects from the military sector, such as unexploded ordnance, chemical munitions and mines, require particular attention. Presently, an operator dressed in a flak jacket with helmet and face shield searches an area with a mine detector until a buried object is located. The operator then must very carefully dig up the object, usually with a trowel or knife, until it is fully uncovered and identifiable. The mine is then disabled. This procedure must be followed for every detector indication, whether erroneous or true. Detection and removal of mines is extremely dangerous, especially when carelessness due to operator fatigue sets in. In typical land mine cleanup operations, it has been reported that for every mine uncovered and deactivated, up to one thousand false hits can be recorded by the mine detector being used. All of these must be carefully excavated by hand. Assuming one minute per excavation, more than sixteen hours can be spent digging up false hits for each live mine found.

In addition, plastic mines and unexploded ordnance usually remain hidden unless they have enough internal metal to trigger a detector. Detection of plastic can be done using subsurface radar. Such systems, however, are expensive, bulky to deploy and difficult to interpret.

A mine plow disclosed in U.S. Pat. No. 5,291,819 provides for delivery of a high velocity gas stream to the ground surface near the mine plow's baskets. The gas stream winnows loose soil material from metal and plastic battlefield debris which has been picked up by the baskets. The mine plow is limited to previously uncovered objects and does not achieve primary excavation of the battlefield debris.

A need remains for a highly mobile, person transportable pneumatic excavator, which can safely uncover buried objects.

Therefore, it is an object of the present invention to provide a pneumatic excavator which can uncover buried objects and, in particular, safely uncover unexploded ordnance.

SUMMARY OF THE INVENTION

The present invention provides for a pneumatic excavator which can safely excavate buried objects. The pneumatic excavator includes a flow conduit defining a passageway having an inlet end and an outlet end. The flow conduit inlet end is adapted to be in fluid communication with a gas supply and a nozzle is disposed at the flow conduit outlet end. A source of pressurized gas provides the gas supply. A movable member disposed within the conduit intermediate the inlet end and the outlet end is adapted to move periodically relative to the conduit so as to block flow through the passageway and pulse a gas passing through the conduit. A manually operable valve fluidly coupled to the conduit is adapted to control the flow of gas passing through the conduit and shut off the flow of gas through the conduit.

The movable member is biased into a blocking position preventing gas from flowing through the conduit by a biasing force. The movable member is moved into an open position when an opposing force, which is a function of a difference in pressure on opposite sides of the movable member, is greater than the biasing force to permit gas to flow through the conduit until the pressure differential across the movable member causes the opposing force to be less than the biasing force.

The conduit can include a first sleeve and a second sleeve slidably disposed within the second sleeve and a sealing member disposed between an outer surface of the second sleeve and an inner surface of the first sleeve. A locking collar is disposed on the first sleeve for retaining the second sleeve within the first sleeve. The nozzle is secured to said conduit through a swivel joint.

More specifically, the movable member includes a manifold within the conduit between the inlet end and outlet end. The manifold defines a piston receiving chamber. A bypass orifice is fluidly coupled to the piston receiving chamber. A biasing member, preferably a spring, is received within the chamber and a piston is slidably received within the chamber and coacts with the biasing member. The biasing member urges the piston to a first position blocking the bypass orifice, thereby blocking flow through the passageway when a pressure differential across the piston is below a first value. The piston moves in a longitudinal direction within the piston receiving chamber to a second position so that the bypass orifice is in fluid communication with the piston receiving chamber and the passageway so that gas can flow through the passageway when the pressure differential across the piston is greater than the first value.

A bleed orifice is defined in a downstream cap positioned at a downstream end of the manifold downstream of the bypass orifice. A seal is provided between the manifold and the conduit upstream of the bypass orifice and is received in a rib attached to the manifold. The bleed orifice is in fluid communication with a portion of the piston receiving chamber that receives the biasing member. A stop is secured to the manifold and positioned within the piston receiving chamber, whereby the piston is positioned between the stop and the biasing member. The cap defining the bleed orifice is secured to the downstream end of the manifold with the biasing member being positioned between the piston and the downstream cap.

An upstream cap can be secured to the manifold at an upstream end of the manifold and upstream of the stop. The upstream cap defines a pilot hole passing therethrough and in fluid communication with the piston receiving chamber. An inlet orifice defined by the manifold is positioned upstream of the bypass orifice and the rib. The piston further defines a flow cavity. When the piston is in the second position, the inlet orifice is in fluid communication with the bypass orifice via the flow cavity so that gas can flow through the passageway. When the piston is in the first position, the bypass orifice is blocked by the piston so that gas cannot flow through the passageway.

In another embodiment of the movable member, a piston is provided that includes a body with an engaging member attached to the body and releasably secured to the manifold. The engaging member includes a flexible member, preferably a spring, having an engaging surface adapted to releasably engage with an inner surface of the manifold. The inner surface of the manifold further defines a pair of spaced apart recesses adapted to receive the engaging surface. The engaging surface is received within one of the recesses when the piston is in the first position and the engaging surface is received within the other of the recesses when the piston is in the second position.

A pilot valve can be disposed within the inlet chamber. The pilot valve has an inlet in fluid communication with the gas supply, a first outlet in fluid communication with the atmosphere and a second outlet in fluid communication with the pilot hole. When the first outlet is in fluid communication with the second outlet, the pilot hole is in fluid communication with the atmosphere and gas is prevented from flowing through the pilot hole defined in the upstream cap. When the inlet is in fluid communication with the second outlet, the pilot hole is in fluid communication with the inlet permitting gas to flow from the source of pressurized gas through the pilot hole.

The present invention further includes a method of excavating having the steps of: providing a source of pressurized gas; fluidly coupling the source of pressurized gas with a conduit; passing pressurized gas through the conduit; pulsing the gas passing through the conduit as the gas exits the conduit; and directing the pulsed gas at a material to be excavated. The exiting gas passes through a supersonic gas nozzle positioned at a discharge end of the conduit, whereby the exiting gas is air and is discharged at a velocity of about Mach 1.5 at about thirty scfm and the pulsing occurs at a frequency of about two to three Hz.

The present invention further includes a method of uncovering buried land mines having a force activated detonation trigger, the method having the steps of: providing a source of pressurized gas; fluidly coupling the source of pressurized gas with a conduit; and directing the gas exiting the conduit at the buried land mine. The gas may be pulsed as it exits the conduit and is directed at the buried land mine at a force less than a force necessary to detonate the land mine.

DESCRIPTION OF THE PREFERRED EMBODIMENTS

Figure 1:
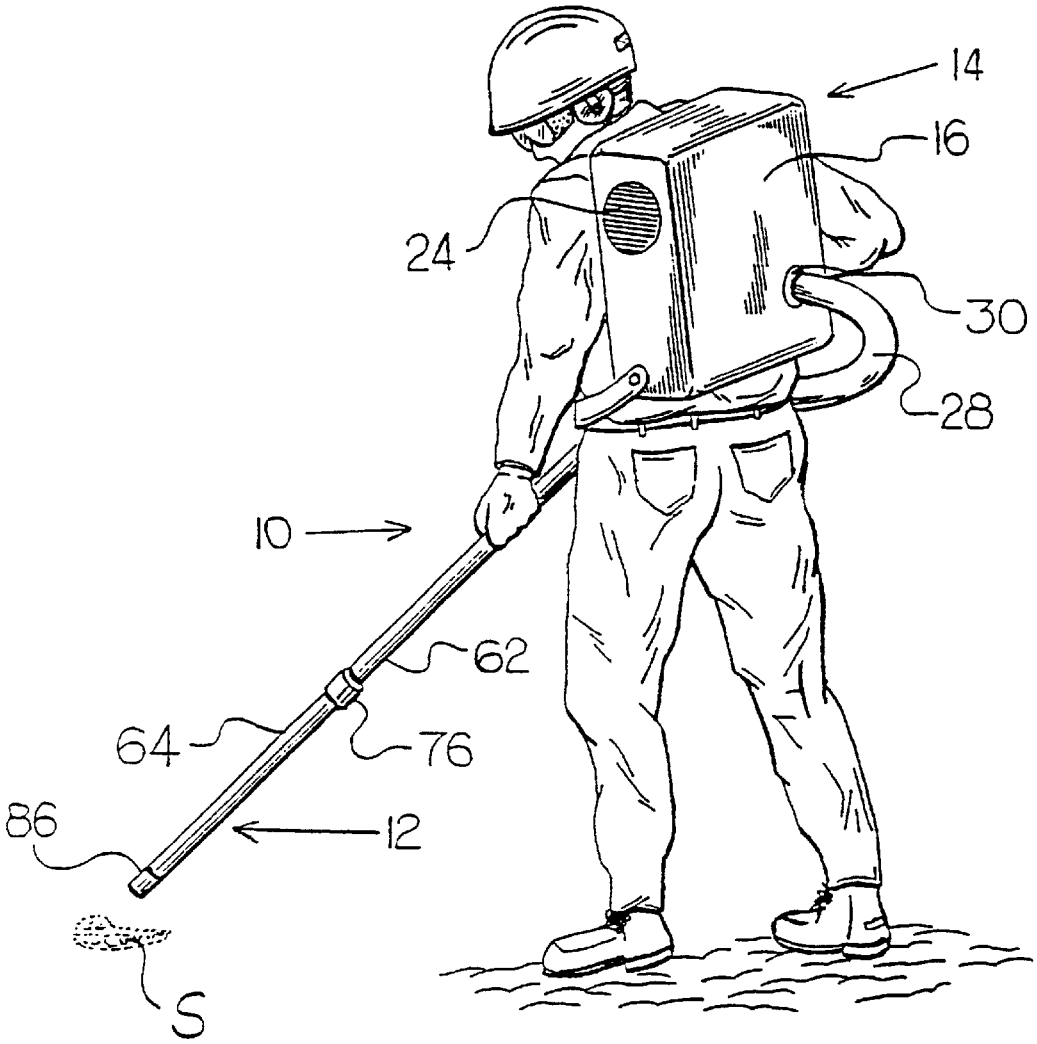
FIG. 1 is a perspective view of a person using a portable pneumatic excavator that includes a hand tool and a power unit made in accordance with the present invention.

FIG. 1 shows a person carrying the pneumatic excavator 10 made in accordance with the present invention. The excavator 10 includes a hand tool 12 and is powered by a separate power unit 14 fluidly connected to the hand tool 12. The hand tool 12 is directed to an area of soil or sand S to be excavated. The power unit 14 includes a housing 16 mounted on a frame 18 (shown in FIG. 2). The housing 16 prevents dirt or liquids from entering the power unit 14 and protects the power unit 14 from general abuse. The housing 16 also serves as a sound attenuator for the noise generated by the internal components of the power unit 14.

The housing 16 is made of a lightweight material, preferably aluminum, durable plastic or a thermosetting resin reinforced by fibrous material, such as polyester resin reinforced with glass fibers. Appropriate sound insulation (not shown) is located on the interior for reducing noises produced by the power unit 14.

Figure 2:
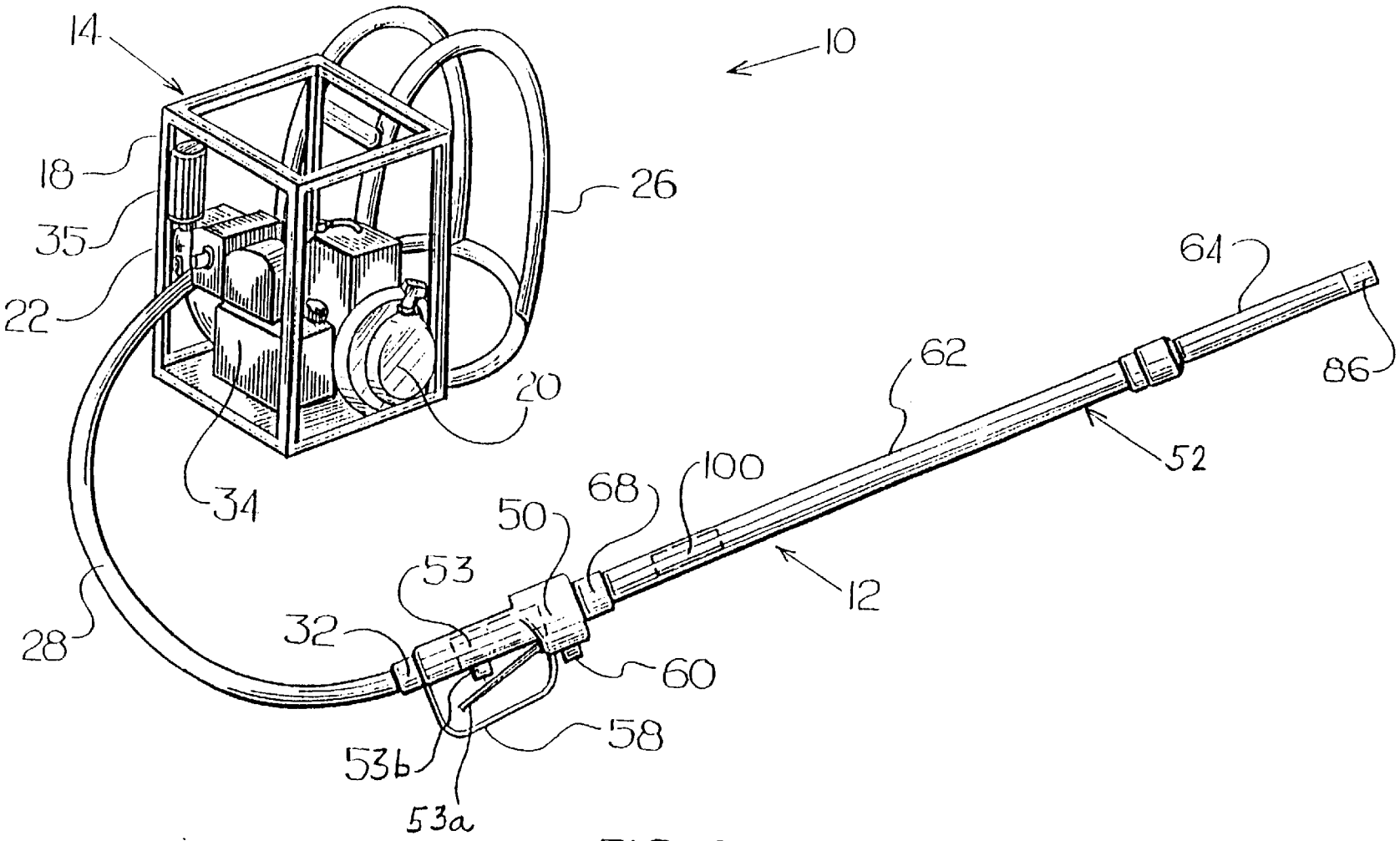
FIG. 2 is a perspective view of a portion of the portable pneumatic excavator shown in FIG. 1.

Referring to FIGS. 1 and 2, the power unit 14 includes an engine 20 and a gas compressor 22, preferably a conventional air compressor. An exhaust 24 is provided to vent air and heat generated by the power unit 14. A back harness 26 is connected to the frame 18 so that the power unit 14 can be carried on a person's back. A flexible supply hose 28 connects the gas compressor 22 to the hand tool 12 via a first connector 30. The supply hose 28 is suitable for use with compressed gas and is typically several feet long with an internal diameter chosen to minimize the pressure drop along its length. The supply hose 28 is attached to the hand tool 12 by a second connector 32. Referring to FIG. 2, which shows the housing 16 removed from the frame 18, a fuel tank 34 is in fluid communication with the engine 20. The gas compressor 22 includes a gas filter intake 35.

Figure 3C:
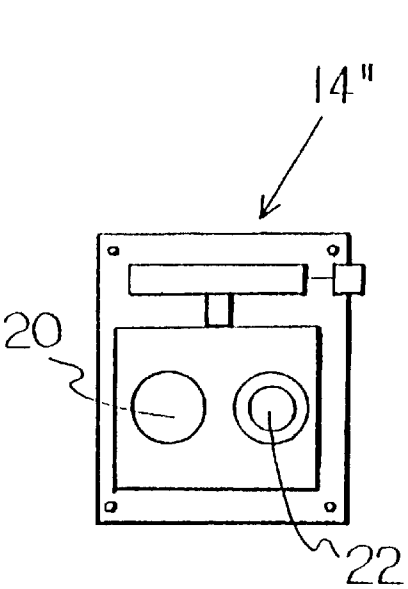
FIG. 3*c* is a top plan view of another alternative embodiment of the power unit shown in FIG. 3*a;*
Figure 3B:
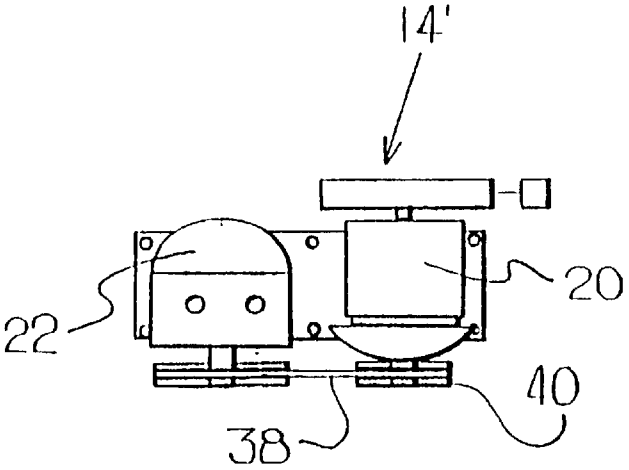
FIG. 3*b* is a top plan view of an alternative embodiment of the power unit shown in FIG. 3*a;*
Figure 3A:
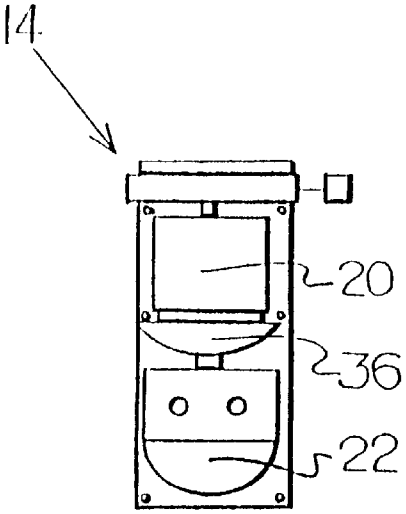
FIG. 3*a* is a top plan view of the power unit of the portable pneumatic excavator shown in FIG. 2.

Referring to FIG. 3*a*, the engine 20 preferably is a conventional gasoline internal combustion (piston or rotary) engine, but alternatively may be powered by diesel, propane or the like. The engine 20 is sized to match the power requirements of the gas compressor 22. Typically, the engine supplies five to ten hp (horsepower) at three thousand to four thousand rpm (revolutions per minute). The engine 20 also includes standard ancillary equipment (not shown), such as air cleaner, rewind starter, exhaust muffler and spark plug which are all well-known in the art.

The gas compressor 22 is preferably a rotary vane compressor and is directly coupled to the engine 20 through a 3:1 or 2:1 ratio gear reducer 36 which is connected to a horizontal shaft (not shown) of the engine 20. Preferably, the gas compressor 22 supplies twenty to thirty scfm (standard cubic feet per minute) of air volume at generally thirty to one hundred psig (pounds per square inch gauge) to the supply hose 28. Optionally, the engine 20 can match the speed requirements of the gas compressor 22 to eliminate the gear reducer 36 and thereby reduce the weight of the power unit 14.

The power unit 14 may be modified as shown in FIGS. 3*b* and 3*c* with like reference numerals used for like elements. In the power unit 14' shown in FIG. 3*b*, the engine 20 and the gas compressor 22 are located in side-by-side relationship and coupled by the use of a standard fan belt 38. In this configuration, an appropriately sized sheave 40 is mounted on the engine shaft to match its rotation rate to the speed required to turn the shaft of the gas compressor 22.

In the power unit 14" shown in FIG. 3*c*, the engine 20 is a modified two-cylinder engine and is also used as a gas compressor. In this configuration, internal combustion powers one cylinder (not shown), which in turn drives the other modified cylinder (not shown) to provide compression. The power unit 14" eliminates the need for a separate compressor and reduces the weight of the power unit. For example, a thirty cubic inch, two-piston engine could produce about thirty-one scfm at eighty-eight psig at a compression ratio of 7:1.

Figure 4A:
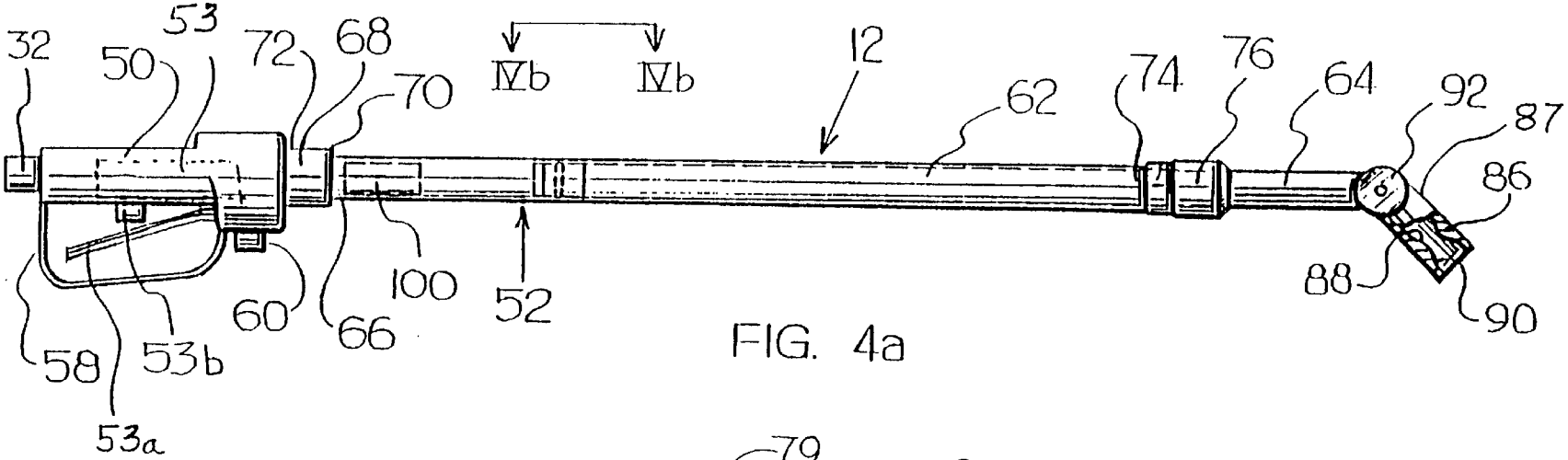
FIG. 4*a* is a side elevational view of the hand tool similar to that shown in FIG. 1 made in accordance with the present invention.
Figure 4B:
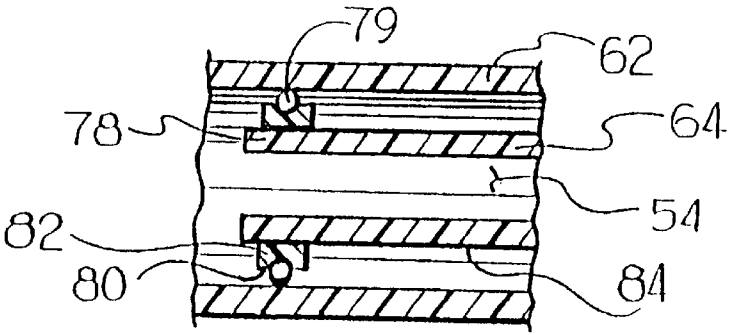
FIG. 4*b* is a section taken along lines IVb—IVb of FIG. 4*a;*

As depicted in FIGS. 4*a* and 4*b*, the hand tool 12 includes a valve body 50 connected to a flow conduit 52 defining a passageway 54 in fluid communication with the valve body 50. A manually operated two-way normally closed lever valve 53 with a spring return is disposed within the valve body 50. Such a valve body 50/lever valve 53 arrangement is available from Ingersoll-Rand Corporation of Woodcliff Lake, N.J. and is well known in the art. When a lever 53*a* is squeezed towards the valve body 50, a plunger 53*b* is depressed and the internal valving (not shown) is actuated such that the compressed gas flows from the gas compressor 22 through the valve body 50 into the flow conduit 52. A trigger guard 58 protects the lever 53*a* from unwanted engagement if the hand tool 12 is placed to rest in such a position that the lever 53*a* might be otherwise engaged. A pressure gauge 60 is mounted on the valve body 50. The pressure gauge 60 displays the available gas pressure in the hand tool 12.

The flow conduit 52 includes a first cylindrically shaped sleeve 62 adapted to slidably receive a second cylindrically shaped sleeve 64 in a telescoping manner as indicated by the phantom lines in FIG. 4*a*. An inlet end 66 of the first sleeve 62 is connected to the valve body 50 via a third connector 68. The inlet end 66 is secured within an end 70 of the third connector 68 with an adhesive or the like, while the other end 72 of the third connector 68 is threaded into the valve body 50. A distal end 74 of the first sleeve 62 is received in a male threaded portion of a twist locking collar 76 and secured into place with an adhesive. A proximate end 78 of the second sleeve 64 passes through a female threaded portion of the locking collar 76 and is slidably received within the first sleeve distal end 74.

Preferably, the first sleeve 62 is about three feet in length and has an internal diameter slightly greater than an outer diameter of the second sleeve 64. The difference between the inner diameter of the first sleeve 62 and the outer diameter of the second sleeve 64 allows the second sleeve 64 to be received within the first sleeve 62 with a sliding fit.

As shown in FIG. 4*b*, a sleeve O-ring 79 is positioned in a groove 80 cut into an annular shoulder 82. The annular shoulder 82 is secured to an outer surface 84 of the second sleeve proximate end 78 with a suitable adhesive. Alternatively, the groove 80 can be cut directly into the second sleeve proximate end 78. An outer diameter of the annular shoulder 82 is greater than an inner diameter of the first sleeve distal end 74.

Both the first sleeve 62 and the second sleeve 64 are formed of a lightweight material, preferably aluminum or a thermosetting resin reinforced by fibrous material, such as polyester or epoxy resin reinforced with glass fibers. Alternatively, they may be made of a suitable plastic, such as polyethylene, typically used for gas pipe. Plastic or reinforced resin sleeves have the advantage of being electrically nonconducting. In addition, they exhibit poor thermal conductivity, and thus will not become appreciably hot from the flow of gas moving therethrough.

A nozzle 86, preferably a supersonic nozzle, is mounted within an outlet end 87 of the second sleeve 64 via a suitable adhesive or the like. The nozzle 86 is typically formed of a non-sparking metal, such as brass or certain AMPCO® metals. Depending upon the requirements of the application, the nozzle 86 can be made of other materials, including metal, such as stainless steel for its rust resistance and/or non-magnetic character, plastic or a combination thereof.

The nozzle 86 is a 26 converging-diverging supersonic gas jet, such as disclosed in U.S. patent application Ser. No. 08/669,212, filed Jun. 24, 1996 entitled "Contoured Supersonic Nozzle" incorporated herein by reference, to provide an increase in velocity of gas discharged from the outlet end 87. An upstream end 88 of the nozzle 86 converges inwardly, while a downstream end 90 diverges outwardly.

As shown in FIG. 4*a*, a swivel joint 92 may be disposed intermediate the proximate and outlet sleeve ends 78 and 87. The swivel joint 92 allows the nozzle 86 to be pointed in various directions and imparts greater flexibility in the use of the pneumatic excavator 10 over soil surfaces having many different contours.

Most of the excavating work performed by the nozzle 86 occurs in the first fraction of a second of supersonic gas stream contact of a soil surface. Time spent over the same spot longer than this is wasted unless the gas stream is moved to excavate new material. The gas stream need only be flowing a short period of time to perform work and can be stopped while the device is moved to a new spot to excavate. An optimal speed for such a duty cycle is about two to three Hz. This reduces the gas volume requirements of the hand tool 12 and, therefore, the size requirement of the gas compressor 22 and the power unit 14. Accordingly, the present invention includes a movable member 100 to periodically pulse the gas flow delivered to the nozzle 86 from the gas compressor 22.

It is believed that the use of a converging-diverging supersonic nozzle allows the gas compressor 22 to be downsized to fit into a backpack unit as depicted in FIG. 1. The pneumatic excavator 10 could also be provided with handles (not shown) for carrying by one or two people or be mounted on a wheeled cart for trailing by one or two people. The movable member 100 also allows further downsizing of the gas compressor 22. It is believed that a suitable gas compressor 22 for such a unit would be driven by approximately five to ten hp and would provide about thirty to one hundred psig pressure and twenty to thirty scfm output flow. The gas compressor 22 would weigh approximately twenty pounds if made of cast iron and under approximately ten pounds if made of aluminum. It is believed that combined with the weight of the engine 20 and the frame 18, the pneumatic excavator 10 would weigh approximately fifty to sixty pounds.

Referring to FIG. 4*a*, the movable member 100 is located adjacent the inlet end 66 of the flow conduit 52 or the movable member 100 may be positioned anywhere within the first or second sleeves 62 or 64. The movable member 100 is adapted to periodically block or pulse gas flow through the passageway 54.

Figure 5A:
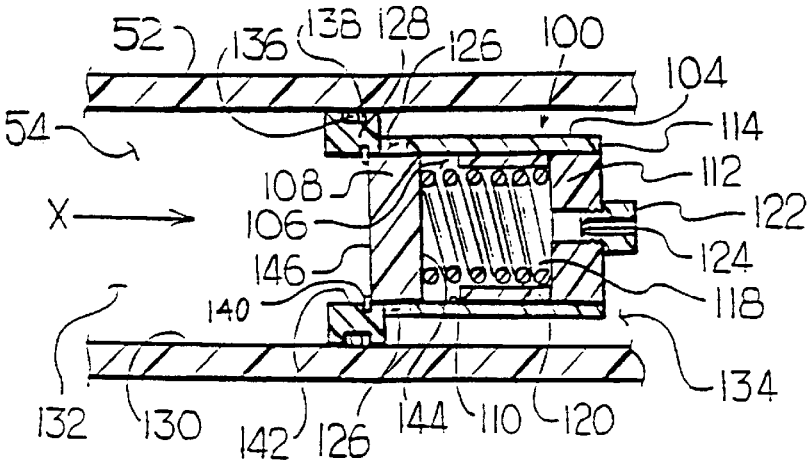
FIG. 5*a* is a sectional elevational side view of a portion of the hand tool showing a movable member in a first position.
Figure 5B:
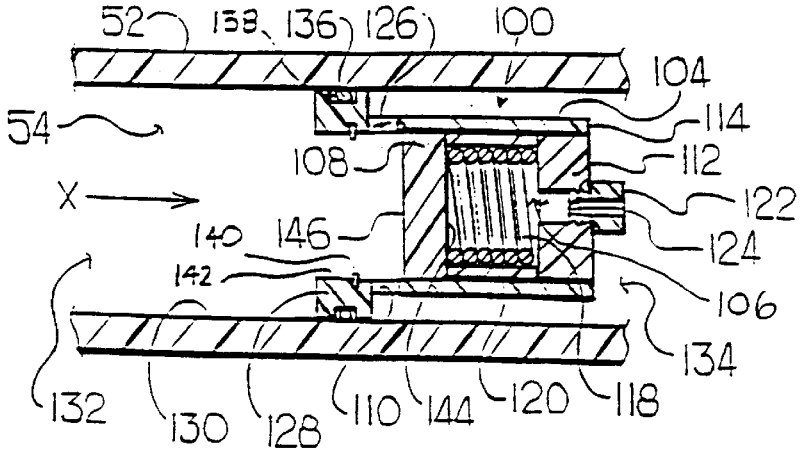
FIG. 5*b* is a sectional elevational side view of the portion of the hand tool shown in FIG. 5*a* with the movable member in a second position.

Referring to FIGS. 5*a* and 5*b*, the movable member 100 includes a manifold 104 defining a piston receiving chamber 106 and a piston 108 slidably received within the piston receiving chamber 106 with an extremely small clearance to provide a high degree of gas sealing. An outer diameter of the piston 108 is preferably on the order of microinches less than an inner diameter of the manifold 104 and the surface finishes of these parts are on the order of microinches. This embodiment of the movable member 100 is used with the two-way normally closed lever valve 53 which provides a separate but complete on/off mechanism for the gas flow.

A removable downstream cap 112 is disposed within the piston receiving chamber 106 at a downstream end 114 of the manifold 104. A biasing member or spring 118 is disposed within the piston receiving chamber 106 between the downstream cap 112 and the piston 108 and urges the piston 108 away from the downstream cap 112. A sleeve or stop 120 is mounted to the manifold inner surface 110 within the piston receiving chamber 106 adjacent the downstream cap 112 and is adapted to prevent movement of the piston 108 towards the downstream cap 112 beyond a predetermined distance. An outlet plug 122 is threaded into the downstream cap 112 and defines a bleed orifice 124 therethrough.

The manifold 104 further defines a plurality of bypass orifices 126 fluidly coupled to the piston receiving chamber 106. When the piston 108 is in a first position as shown in FIG. 5*a*, the piston 108 covers the bypass orifices 126, thereby blocking gas flow through the bypass orifices 126. An annular rib 128, disposed between the manifold 104 and an inner surface 130 of the flow conduit 52 in conjunction with the manifold 104, defines an inlet chamber 132 and an outlet chamber 134. An O-ring 136 disposed in an annular rib groove 138 defined in the annular rib 128 provides a seal between the annular rib 128 and the flow conduit inner surface 130. A retaining ring 140 mounted on an inner surface 142 of the annular rib 128 retains the piston 108 within the manifold 104.

In use, compressed gas, preferably compressed air, is delivered to the hand tool 12 and flows through the flow conduit 52 and into the inlet chamber 132 when the plunger 53*b* is depressed. The gas compressor 22 is fluidly coupled via the first connector 30, supply hose 28 and second connector 32 to the valve body 50. The pressurized gas passes through the sleeves 62 and 64. The piston 108 is initially in a first position as depicted in FIG. 5*a* such that the bypass orifices 126 are covered by the piston 108 and gas flow through the passageway 54 is blocked. In the first position, a pressure differential across the piston 108 is below a first value and a force exerted by the spring 118 against a downstream side 144 of the piston 108 is greater than the force of the gas against an upstream side 146 of the piston 108.

As depicted in FIG. 5*b*, as the pressurized gas flows into the inlet chamber 132, the pressure differential across the piston 108 becomes greater than the first value and the piston 108 moves in a longitudinal direction shown by arrow X within the piston receiving chamber 106 to a second position so that the bypass orifices 126 are in fluid communication with the outlet chamber 134. The compressed gas then flows through the passageway 54, the bypass orifices 126 and into the outlet chamber 134 such that the pressure in the outlet chamber 134 rises and the compressed gas flows out through the nozzle 86.

As the piston 108 moves to the second position, the gas flows slowly through the bleed orifice 124 from the outlet chamber 134 into the piston receiving chamber 106. The pressure in the outlet chamber 134 increases because of the restriction of the gas flow through nozzle 86. The diameter of the bleed orifice 124 (typically on the order of 0.01 to 0.02 inch) controls the rate at which gas passes through the bleed orifice 124 and thus the rate at which the pressure increases in the piston receiving chamber 106. As the pressure in the piston receiving chamber 106 increases, the pressure differential across the piston 108 returns to the first value and the piston 108 slides back to the first position. When the piston 108 returns to the first position, the flow of gas to the outlet chamber 134 is cut off. The compressed gas rapidly exits the outlet chamber 134 through the nozzle 86 while simultaneously gas in the piston receiving chamber 106 slowly flows back out through the bleed orifice 124 into the outlet chamber 134. Thus, the pressure in the outlet chamber 134 decreases more rapidly than the pressure in the piston receiving chamber 106.

When the gauge pressure in the piston receiving chamber 106 is low enough, the compressed gas flowing into the inlet chamber 132 causes the pressure differential across the piston 108 again to increase to the first value and the piston 108 again slides to the second position. Thus, when the difference between the pressure over an area of the piston downstream side 144 and the pressure over an area of the piston upstream side 146 is greater than the biasing force of the spring 118, the movable member 100 moves to an open position to permit the gas to flow through the flow conduit 52 until the force applied to the piston 108 due to the pressure differential across the piston 108 is less than the biasing force.

Movement of the piston 108 between the first and second positions results in a pulsing of gas through the outlet chamber 134 and the nozzle 86. The frequency is affected by the upstream and the downstream compressed gas pressures, the spring constant K of the spring 118, the diameter of the bleed orifice 124, the area of the piston upstream and downstream sides 146 and 144 and the volume of the piston receiving chamber 106. Thus, the relative rates at which the outlet chamber 134 and the piston receiving chamber 106 fill and empty, control the frequency with which the piston 108 moves and the length of time the piston 108 remains in each of the first and second positions.

When compressed air is used, the velocity of air exiting the nozzle 86 is about Mach 1.5 and the air is pulsed at a frequency of about two to three Hz (hertz). By flowing the air at a velocity of about Mach 1.5 at about forty psig, forty percent less horsepower is required to compress gas than in other systems delivering air at Mach 2 and about ninety psig. Additional benefits of delivering compressed air at Mach 1.5 include a reduced amount of heat generated by the air passing through the hand tool 12 so the hand tool. 12 may be hand-held, higher energy efficiency (less fuel required), smaller sized and lighter weight equipment, less blowback of soil, improved digging performance and increased safety to an operator.

The gas directed at an object to be excavated is pulsed. It is also possible to operate the movable member 100 in a continuously open basis. This is achieved by either completely blocking the bleed orifice 124 or venting the piston receiving chamber 106 to atmosphere directly through a hose (not shown).

Figure 6A:
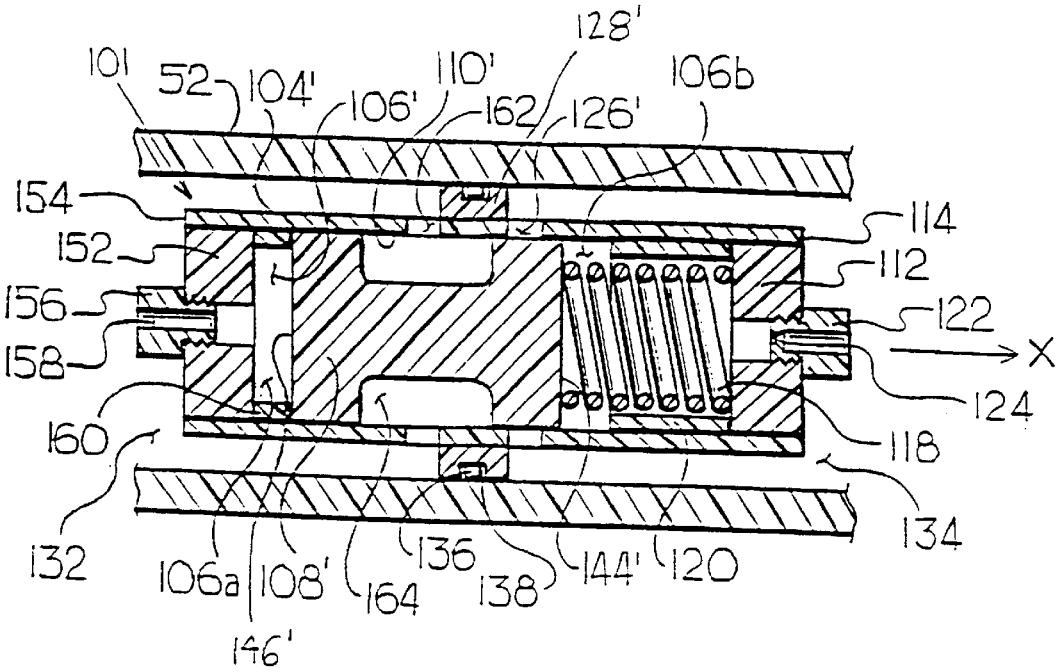
FIG. 6*a* is a sectional side elevational view of a second embodiment of a portion of the hand tool shown in FIG. 1 showing a movable member in a first position made in accordance with the present invention.
Figure 6B:
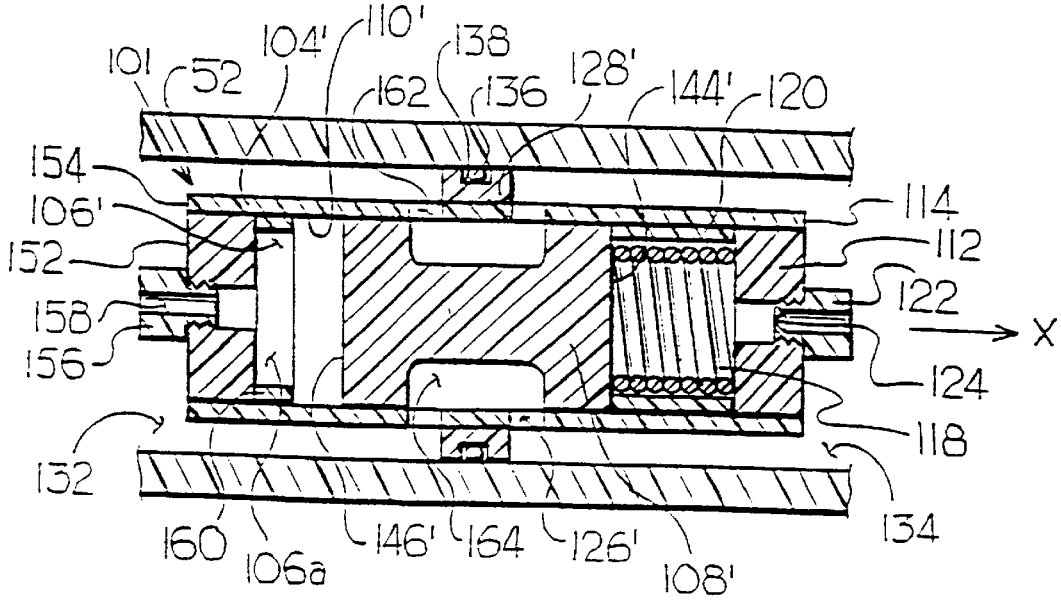
FIG. 6*b* is a sectional side elevational view of the portion of the hand tool shown in FIG. 6*a* showing the movable member in a second position.

A preferred embodiment of the movable member 101 is depicted in FIGS. 6*a* and 6*b*, wherein elements common to the first embodiment of the movable member 100 have the same reference numerals. A removable upstream cap 152 is disposed within the piston receiving chamber 106' at an upstream end 154 of the manifold 104'. An inlet plug 156 threaded into the upstream cap 152 defines a pilot hole 158 fluidly coupled to the inlet chamber 132 and the piston receiving chamber 106'. A spacer 160 is mounted to the manifold inner surface 110' within an upstream portion 106*a* of the piston receiving chamber 106' between a piston upstream side 146' and the upstream cap 152.

The manifold 104' includes two inlet orifices 162 positioned upstream of two bypass orifices 126' on an opposite side of an annular rib 128' from the bypass orifices 126'. The manifold 104' may alternatively include one or more than two of each of the inlet orifices 162 and the bypass orifices 126'. A piston 108' further defines a flow cavity 164, preferably an annular recess.

The movable member 101 operates similarly to the movable member 100. As shown in FIG. 6*a*, when the piston 108' is in the first position, the inlet orifices 162 are fluidly coupled to both the inlet chamber 132 and the flow cavity 164. The bypass orifices 126' are covered by the piston 108' blocking gas from flowing into the outlet chamber 134. As shown in FIG. 6*b*, when the piston 108' is in the second position, the inlet orifices 162 are in fluid communication with the bypass orifices 126' via the flow cavity 164 so that gas can flow through the passageway 54 and to the nozzle 86.

In use, the piston 108' is initially in the first position as shown in FIG. 6*a*. The inlet chamber 132, the outlet chamber 134 and the piston receiving chamber 106' are all at atmospheric pressure. When compressed gas is introduced into the inlet chamber 132, compressed gas fills the flow cavity 164 via the inlet orifices 162, but the compressed gas cannot flow into the outlet chamber 134 because the bypass orifices 126' are blocked by the piston 108'. The compressed gas also flows into the upstream portion 106*a* through the upstream plug 156 via the pilot hole 158. The gas pressure in the upstream portion 106*a* rises rapidly as compressed gas flows through the pilot hole 158.

When the pressure differential across the piston 108' is greater than the first value, the piston 108' moves longitudinally in the direction of the arrow X to a second position. As shown in FIG. 6*b*, when the piston 108' is in the second position, the inlet chamber 132, the inlet orifices 162, the flow cavity 164, the bypass orifices 126' and the outlet chamber 134 are all in fluid communication with one another such that compressed gas flows from the inlet chamber 132 to the outlet chamber 134. From the outlet chamber 134, gas flows through flow conduit 52 and exits the hand tool 12 to the atmosphere through the nozzle 86. At a maximum gas flow rate through the hand tool 12, the pressure differential across the movable member 101 is small, on the order of a few psig, for example, ten psig.

The compressed gas then flows slowly through the bleed orifice 124 from the outlet chamber 134 into a downstream portion 106*b* of the piston receiving chamber 106'. As in the first embodiment of the movable member 100, adjusting the diameter of the bleed orifice 124 controls the rate of gas flowing through the bleed orifice 124 and the rate that the pressure in the downstream portion 106*b* increases. Typically, the diameter of the orifice will be on the order of 0.01 inch to 0.02 inch. As the pressure in the downstream portion 106*b* increases, the piston 108' is pushed back to the first position. When the piston 108' returns to the first position, the flow of gas to the outlet chamber 134 is cut off. Gas also discharges rapidly through the sleeves 62 and 64 and the nozzle 86 reducing the pressure in the outlet chamber 134 to atmospheric. As in the movable member 100, pressure in the outlet chamber 134 decreases more rapidly than the pressure in the downstream portion 106*b*.

When the gauge pressure in downstream portion 106*b* is low enough, the compressed gas in the inlet chamber 132 again pushes the piston 108' to the second position and gas in the outlet chamber 134 flows through the bleed orifice 124 into the downstream portion 106*b*. Thus, when the difference between the pressure over an area of a piston downstream side 144' and the pressure over an area of a piston upstream side 146' is greater than the biasing force of the spring 118, the movable member 101 moves into the second position or an open position to permit the gas to flow through the flow conduit 52 until the force applied to the piston 108' due to pressure differential across the piston 108' is less than the biasing force. Movement of the piston 108' between the first and second positions results in a pulsing of gas through the outlet chamber 134 and the nozzle 86. The frequency of the movement of the piston 108' is affected by the pressures of the upstream and downstream compressed gases, the surface area of the piston upstream and downstream sides 146' and 144', the spring constant K of the spring 118, the diameter of the bleed orifice 124 and the volume of the downstream portion 106*b*. The frequency of the pulsing of the piston 108' and the length of time the piston 108' remains in each of the first and second positions is controlled in a manner similar to that of the movable member 100.

Figure 7:
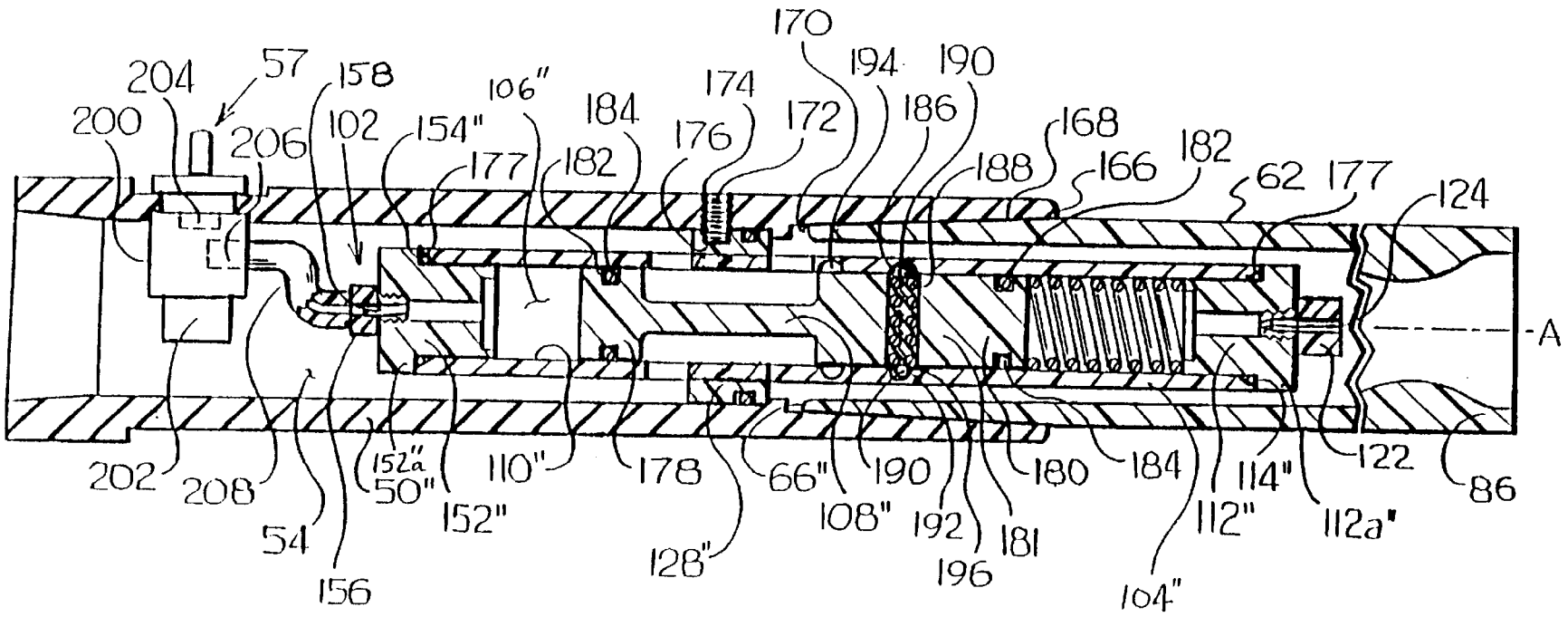
FIG. 7 is a sectional side elevational view of a third embodiment of a portion of a hand tool showing a movable member in a second position made in accordance with the present invention.

A movable member 102 can be used in lieu of the previously-described movable members 100 and 101. The movable member 102, which is a most preferred embodiment, is depicted in FIG. 7 and is incorporated in the hand tool 12" depicted in FIG. 8. The movable member 102 is disposed within the passageway 54 defined by a valve body 50" and the first sleeve 62. A first sleeve inlet end 66" is force fitted into an outlet end 166 of the valve body 50". An outer surface 168 of the first sleeve 62 is tapered and cooperates with a tapered inner surface 170 of the valve body 50". A set screw 172 extends through a screw hole 174 disposed in the valve body 50" and threads into a hole 176 in an annular rib 128".

Similar to movable member 101, the movable member 102 includes a manifold 104" having ends 154" and 114" and defining a piston receiving chamber 106", a downstream cap 112" with an integral flange 112*a*", an upstream cap 152" with an integral flange 152*a*", an outlet plug 122 and a piston 108" having an upstream portion 178 and a downstream portion 180. The movable member 102 also includes a pair of flange O-rings 177 disposed between flanges 112*a*" and 152*a*" and respective ends 154" and 114", an inlet plug 156, a pair of annular piston grooves 182 defined in each of the upstream portion 178 and downstream portion 180, a pair of piston O-rings 184 received within each of the annular piston grooves 182 and slidably engaged with a manifold inner surface 110" of the manifold 104" for sealing and alignment purposes.

The piston downstream portion 180 includes a body 181 defining a bore 186 extending perpendicular to a longitudinal axis A of the piston 108". An engaging member 188, preferably a flexible member or a spring, having two ends 190, is received within the bore 186 and includes one or a pair of engaging surfaces 192 attached to the ends 190. The engaging surfaces 192, preferably spherically shaped, are adapted to cooperate with a first pair of recesses 194 in the manifold inner surface 110" when the piston 108" is in the first position and, as depicted in FIG. 7, to cooperate with a second pair of recesses 196 in the manifold inner surface 110" when the piston 108" is in the second position. Pulsing of the movable member 102 occurs in a manner similar to the pulsing of the movable member 101. The flexible member 183 and the engaging surfaces 192 aid in maintaining the pulsing nature of the movable member 102.

Figure 8:
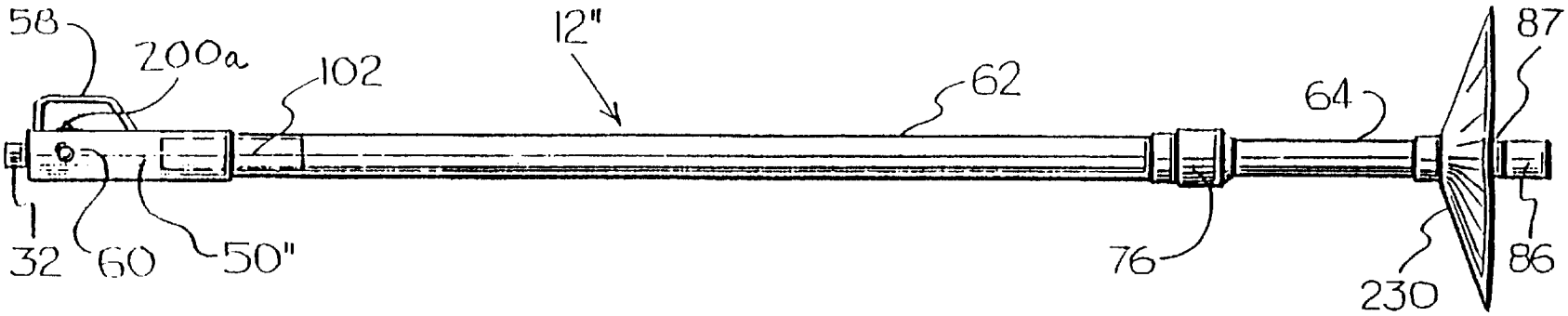
FIG. 8 is a side elevational view of another embodiment of the hand tool made in accordance with the present invention.

As shown in FIG. 8, the hand tool 12" includes the movable member 102 and a manually operated pilot valve 200 having a push button 200*a*. A suitable push-button valve 200 is a three-way normally closed push-button valve manufactured by Clippard Instrument Laboratory, Inc. of Cincinnati, Ohio, Model No. MAV-3. The pilot valve 200 is disposed upstream of the inlet plug 156 as shown in FIG. 7. The pilot valve 200 includes an inlet 202 in fluid communication with the passageway 54, a first outlet 204 in fluid communication with the atmosphere and a second outlet 206 in fluid communication with the pilot hole 158 via a connector hose 208. When the pilot valve 200 is in a normal (closed) state, the second outlet 206 is in fluid communication with the first outlet 204 and the atmosphere. The inlet 202 is closed preventing gas from flowing into the movable member 102. When the pilot valve 200 is in an open state, the inlet 202 is in fluid communication with the second outlet 206 and gas flows into the movable member 102. The pilot valve 200 is manually operated between the closed and open states via depressing the push button 200*a* in a conventional manner.

The pilot valve 200 and the movable member 102 may be disposed within the first sleeve 62, thus obviating a need for the valve body 50". The pilot valve 200 likewise may also be used with the movable member 101 either disposed within the valve body 50 or in the first sleeve 62.

As shown in FIG. 8, the hand tool 12" further includes a dirt shield 230 mounted on the outside of the second sleeve outlet end 87. The dirt shield 230 is preferably made of rubber and may be planar or frustoconical in shape. The dirt shield 230 may also be used with the hand tool 12.

Figure 9:
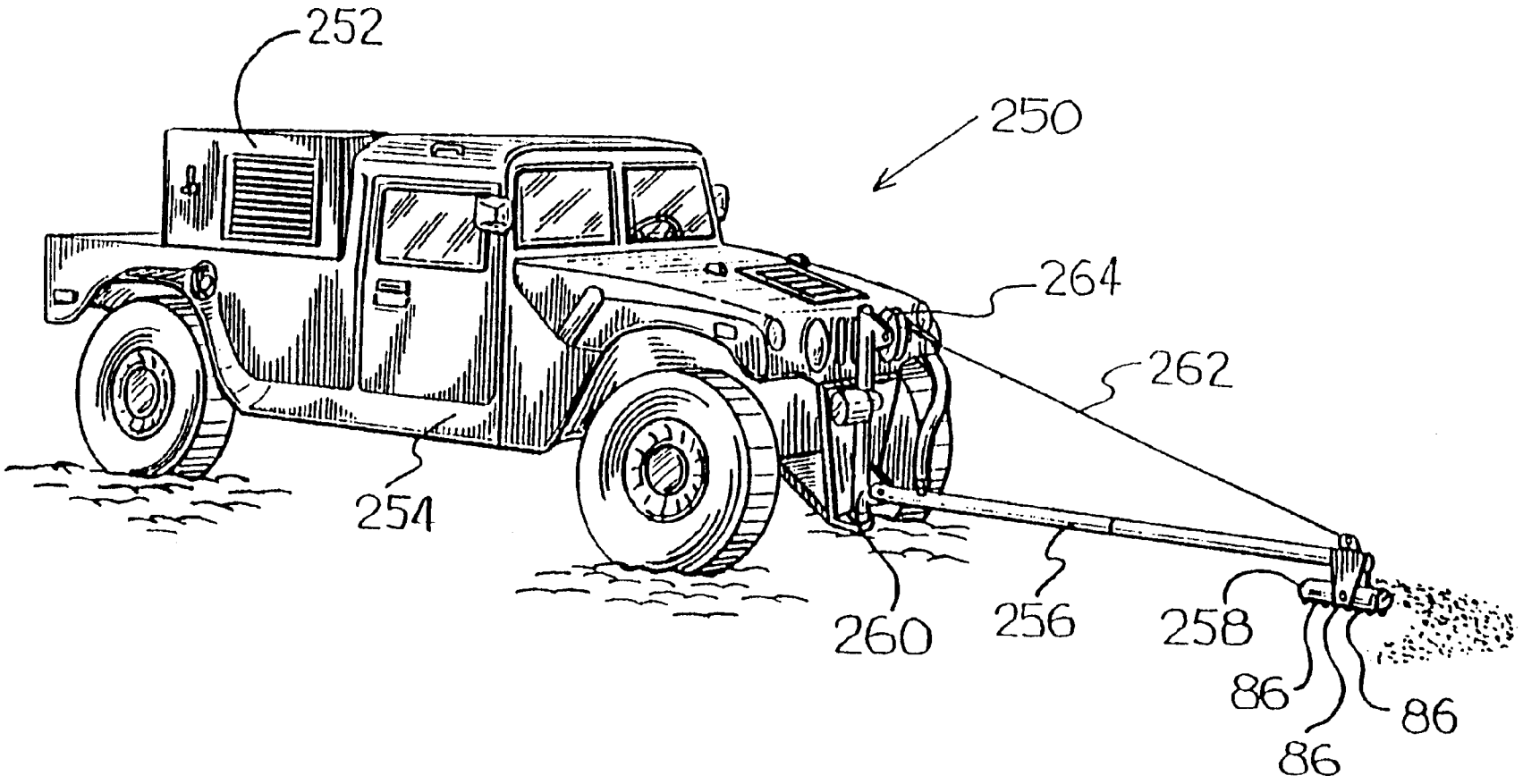
FIG. 9 is a perspective view of a vehicle-mounted movable pneumatic excavator made in accordance with the present invention.

FIG. 9 shows a vehicle-mounted pneumatic excavator 250 of the invention which uses the basic components of the aforedescribed hand-operated invention but in a larger form for more robust capability. An equipment package 252 houses a larger power unit (not shown) mounted on the back of a high-mobility multipurpose wheeled vehicle 254 for ease of transport. An auxiliary air port (not shown) is available to provide compressed gas to a plurality of nozzles 86. The vehicle-mounted pneumatic excavator 250 may be operated by a driver of the vehicle 254, either manually or automatically, for instance, in demining operations.

The gas compressor (not shown) of the equipment package 252 is connected via a gas hose (not shown) to a boom tube 256 having an excavation head assembly 258 at one end thereof. The excavation head assembly 258 includes a plurality of gas nozzles 86 each in fluid communication with the gas compressor. The equipment package 252 provides sufficient gas supply to the plurality of nozzles 86 for excavation of more area per unit time than may be accomplished using the portable pneumatic excavator 10. The excavation head assembly 258 is swept from side to side in front of the vehicle 254 by a boom rotator 260. An object, for example, an unexploded ordnance buried in the ground is uncovered in front of the vehicle 254 by the excavation head assembly 258. An adjustable cable 262 extends from the excavation head assembly 258 to a winch 264 mounted on the vehicle 254 and allows elevation of the boom tube 256 to accommodate varying terrain levels. The movable members 100, 101 or 102 may be incorporated into the vehicle mounted excavator 250, such as in the boom tube 256 or in the excavation head assembly 258 to pulse gas delivered through the nozzles 86.

The pneumatic excavator 10 of the present invention directs a high velocity gas to dislodge soil or sand surrounding a buried article. The present invention can safely uncover buried objects and, in particular, unexploded ordnance without the need to use the hard cutting edges of blades, buckets, shovels, picks or digging bars. Most types of soil may be effectively penetrated and dislodged. Nonporous objects are unharmed by the pneumatic excavator 10. in use, the pneumatic excavator 10 is two to three times faster than hand excavation and can be used to excavate rocky types of soils where a shovel cannot be used. The nozzle can be sized for different gas flow rates depending on the excavation rate required. The nozzle delivers gas at a minimum of twice the momentum force per unit area to the soil than a conventional "air lance" or open pipe. The supersonic gas nozzle is more energy efficient and requires less gas than prior art devices. The nozzle emits a more focused, less dissipative supersonic gas stream than prior art devices, which results in a reduction of dust and debris blowback from the tool. The supersonic gas stream has more focused kinetic energy and momentum than the airstream from a pipe or the nozzles used in prior art devices. Cohesive soils with higher strengths are effectively excavated.

For a given size of compressor, the pneumatic excavator can do more work and move more material than gas delivered from a pipe of the prior art. The flow conduit 52 allows the user to tailor the length of the pneumatic excavator 10 to the job for which it is being used. The nozzle 86 is replaceable when worn or when particular excavating conditions require specialized nozzles. The swivel joint 92 allows the nozzle 86 to be pointed into areas which might otherwise be difficult to reach. The pneumatic excavator 10 is a lightweight portable system or may be used in multiples for larger excavations.

Figure 10:
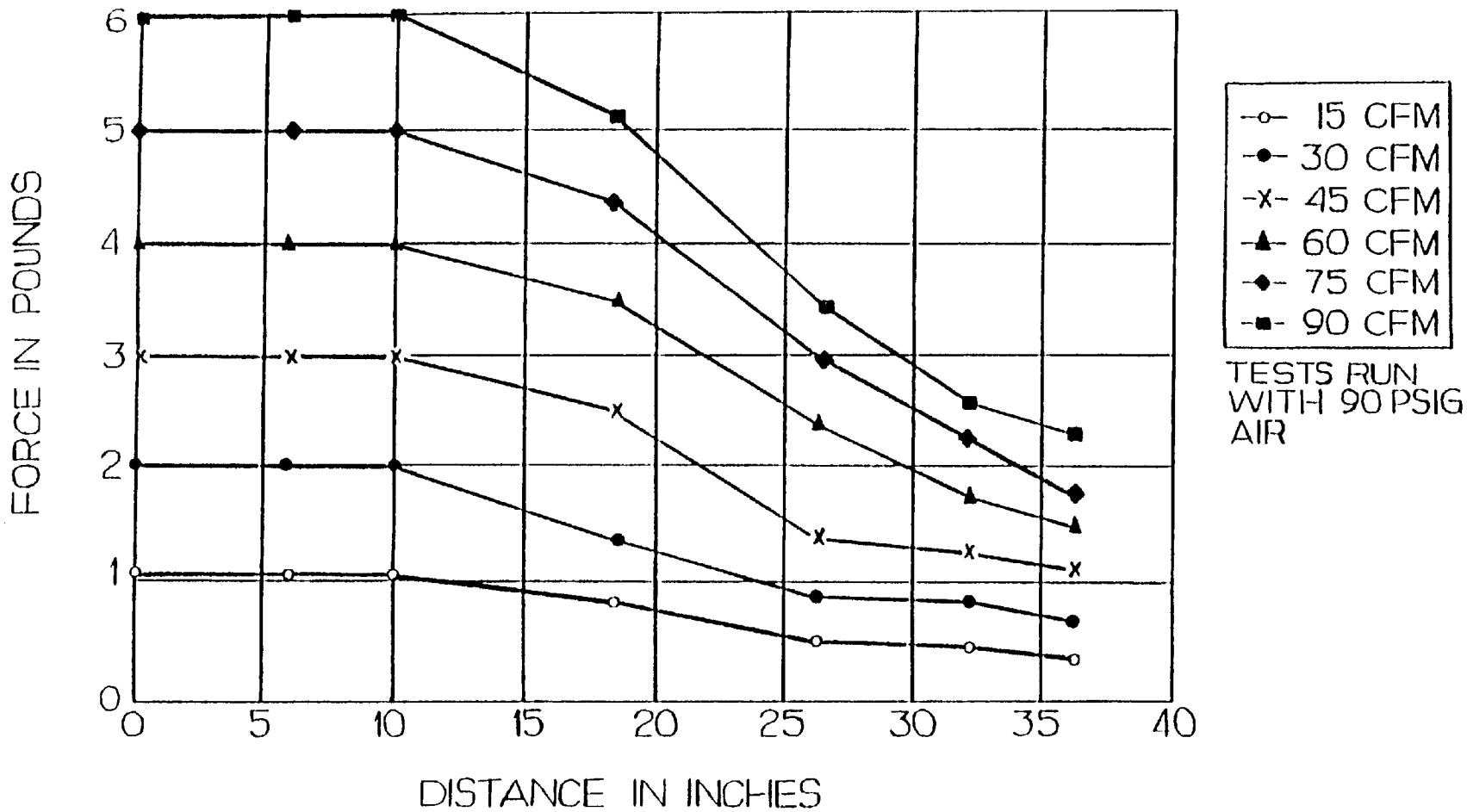
FIG. 10 is a graph showing the variation of supersonic gas force experienced by an object being excavated versus the volume of air flow through a supersonic nozzle and the distance of the nozzle exit from the object.

The nozzle 86 of the present invention can be sized to carefully limit the total amount of force applied to the soil or a buried object. This is of key significance to military applications. In particular, mines represent a class of ordnance that is deliberately made to be very sensitive to disturbance and trigger at specific forces. Typical supersonic gas excavation nozzles of the present invention were tested to measure the total force generated at specific distances from each nozzle. As shown in FIG. 10, the force generated by each nozzle is initially constant close to the nozzle exit and then falls off gradually with increasing distance. This force is proportional to the gas flow rate and varies from one to several pounds depending upon the type of nozzle. Because of this, by appropriate selection of pressure used, the present invention can be sized to apply a force generally less than the triggering force of most buried unexploded ordnance or mine encountered. Consequently, buried unexploded ordnance or mines can be fully uncovered without accidental detonation. The nozzle may be made of brass, stainless steel, plastic, other non-magnetic materials, or a combination thereof for those mines having detonators or fuses activated by sensing metal that is magnetic.

A hand tool employing a supersonic nozzle is two to three times faster than hand excavation using hand tools such as shovels, trowels and the like. This translates into a savings of more than eight to eleven hours per live mine found—without accidental detonation caused by operator carelessness or fatigue. Demining thus becomes faster, less costly and safer. The present invention can uncover mines, either metallic or plastic, without the aid of a mine detector.

The pneumatic excavator of the present invention can be employed in rough terrain, does not harm nonporous objects, and thus can be used anywhere to safely uncover objects or dig holes. In the archaeological sector, the pneumatic excavator can be used for safely digging up buried artifacts or fossils without fear of damage to the buried article. In the agricultural sector, young nursery stock may be dug up for transplantation without damaging their root systems. For domestic use, homeowners can use the pneumatic excavator to safely excavate around foundations, footers or buried pipes as well as to dig post holes or turn over soil in a garden or to aerate plants. For forestry use, holes for the planting of tree seedlings can be dug or root systems can be uncovered for the safe transplanting of stock. The pneumatic excavator is also useful for general excavation in landscaping.

Figure 11:
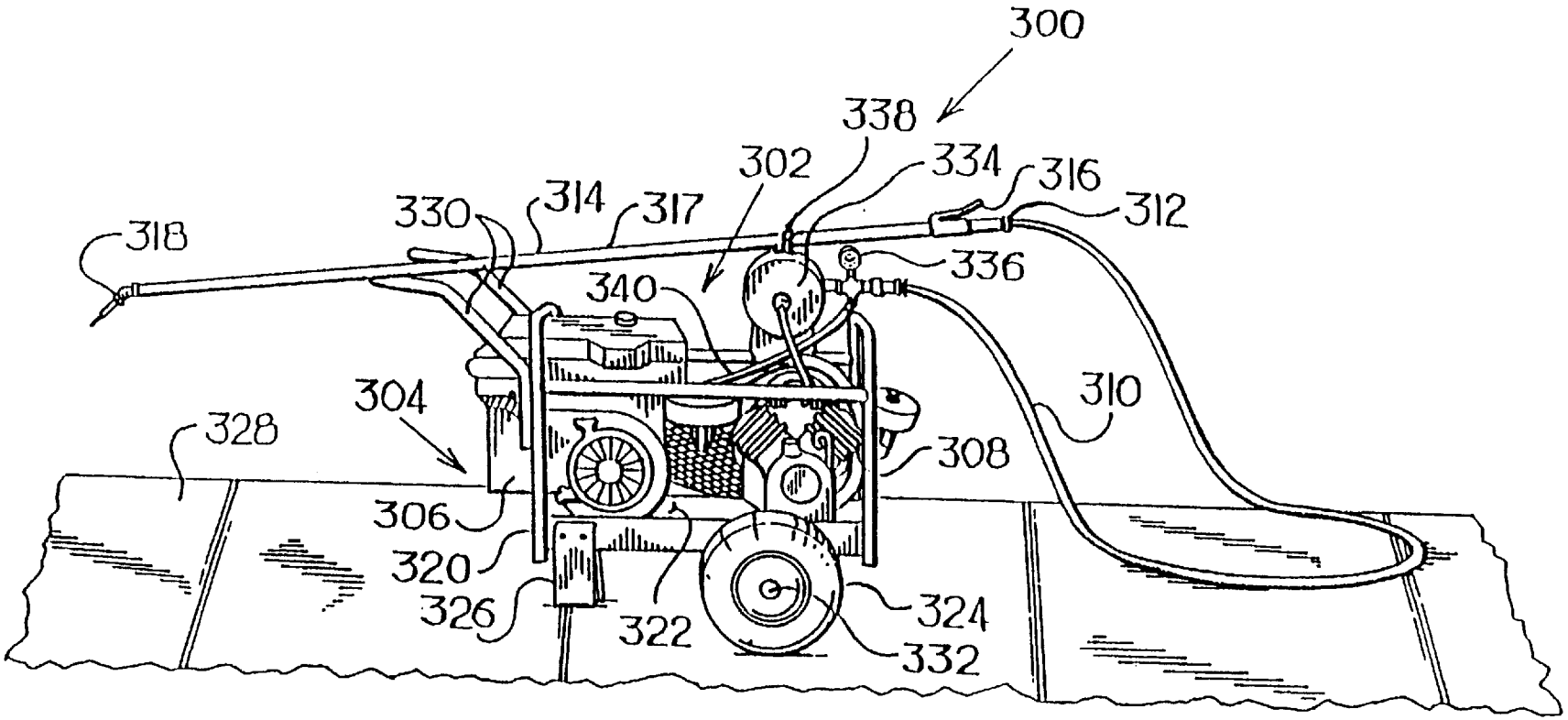
FIG. 11 is a perspective view of a movable pneumatic excavator made in accordance with the present invention.

FIG. 11 shows a movable pneumatic excavator 300 made in accordance with the present invention that includes an equipment package 302 mounted to a wheeled vehicle or cart 304. The movable pneumatic excavator 300 is a manually operated vehicle unlike a power driven vehicle as shown in FIG. 9. The equipment package 302 includes a gasoline internal combustion engine 306 that is coupled to a piston air compressor 308. The air compressor is preferably single stage, although a double stage may be used also. The gasoline internal combustion engine 306 drives the single stage piston air compressor 308 using a centrifugal clutch and belt in a manner well known in the art. A flexible hose 310 is in fluid communication with an exit port of the single stage piston air compressor 308 so that compressed gas, such as air, can be provided to the flexible hose 310. A quick connect coupling 312 attaches an end of the flexible hose 310 to a hand tool 314, such as the previously described hand tool 12. The hand tool 314 includes a flow control lever valve 316 and a conduit 317. The conduit 317 includes a flow passageway that is in fluid communication with the flexible hose 310. An inlet end of the conduit 317 is in fluid communication with the piston air compressor 308. A converging-diverging supersonic nozzle 318, such as the nozzle 86 previously discussed, is attached to a distal end of the conduit 317. The converging-diverging supersonic nozzle 318 and the conduit 317 can be made of the previously described materials and the conduit 317 can be telescoping as previously described. The nozzle may be mounted at an angle, such as 45°, to the axis of the conduit to easily allow the operator to keep the nozzle perpendicular to the ground while standing. The previously described movable member 100 or the other previously described pulsing arrangements may be provided if pulsing is desired.

The cart 304 includes a cart frame 320 and a base 322 attached to the cart frame 320. The gasoline internal combustion engine 306 and the piston air compressor 308 are secured to the base 322. Two wheels 324 (of which only one is shown) are rotatably secured to opposite sides of the cart frame 320 near a forward end thereof; and two supports 326 (of which only one is shown) are secured to opposite sides of the cart frame 320 near a rearward end thereof. Lower ends of the supports 326 are adapted to rest on a supporting surface 328, such as the ground, when the movable pneumatic excavator 300 is in a parked position. Handles 330 are secured to the cart frame 320, whereby when an operator raises the handles 330 in an upwardly direction, the cart frame 320 pivots about a pivot axis 332 causing the supports 326 to be lifted off the supporting surface 328.

The cart unit also carries a tank 334 which compensates for the pulsations of the piston of the air compressor 308. Not shown is an air-to-air heat exchanger which reduces the temperature of the air exiting the air compressor 308 to a level safe for handling. A pressure guage 336 and relief valve 338 are provided on the tank 334.

Other types of air compressors, such as rotary, vane, scroll or rotary screw may be used instead of the piston type described. A small diesel engine may be, also, substituted for the small gas engine.

In operation, an operator moves or lifts the handles 330 upwardly pivoting the cart frame 320 and lifting the supports 326 off the supporting surface 328. The operator then moves the cart 304 by pushing or pulling on the handles 330 causing the wheels 324 to rotate on the supporting surface 328 and permitting the cart 304 to move on the supporting surface 328. Once the cart 304 is positioned at the desired location, the cart frame 320 is lowered so that the lower ends of the supports 326 rest on the supporting surface 328. The operator can then start the gasoline internal combustion engine 306, which drives the piston air compressor 308 to provide a flow of compressed gas, in this case air, to the flexible hose 310. The pressure of the compressed air and flow rates supplied to the flexible hose 310 are the same as previously discussed. The operator then holds the hand tool 314, such as shown in FIG. 1, and can direct the converging-diverging supersonic nozzle 318 to where excavation is to take place. Squeezing the lever of the flow control lever valve 316 permits compressed air to pass through the flexible hose 310, the conduit 317 and the converging-diverging supersonic nozzle 318 to the site to be excavated. Releasing the lever of the flow control lever valve 316 stops the flow of compressed air through the hand tool 314. The engine is equipped with a throttle control 340 such that when the tool is not being used, the engine speed is reduced to idle to save power. The air compressor may preferably be equipped with head unloaders. When the engine is reduced to idle, the head unloaders open so that the compressor does not compress air. The compressed air exiting the converging-diverging supersonic nozzle 318 can be pulsed if the movable member 100 or other pulsing arrangement is provided.

Although the present invention has been described in detail in connection with the discussed embodiments, various modifications may be made by one of ordinary skill in the art without departing from the spirit and scope of the present invention. Therefore, the scope of the present invention should be determined by the attached claims.

We claim:

1. A pneumatic excavator, comprising:

a flow conduit defining a passageway having an inlet end and an outlet end, said flow conduit inlet end adapted to be in fluid communication with a gas supply;

a nozzle disposed at said outlet end of said conduit; and a movable member disposed within said conduit intermediate said inlet end and said outlet end, said movable member adapted to move periodically relative to said conduit so as to block flow through said passageway and pulse a gas passing through said conduit.

2. A pneumatic excavator as claimed in claim 1, further comprising a manually operable valve fluidly coupled to said conduit adapted to control the flow of a gas passing through said conduit.

3. A pneumatic excavator as claimed in claim 2, wherein said manually operable valve is adapted to shut off the flow of gas through said conduit.

4. A pneumatic excavator as claimed in claim 1, further comprising a source of pressurized gas in fluid communication with said conduit.

5. A pneumatic excavator as claimed in claim 1, wherein said movable member is biased into a blocking position preventing gas from flowing through said conduit by a biasing force, whereby said member is moved into an open position when an opposing force, which is a function of a difference in pressure on opposite sides of said member, is greater than the biasing force to permit gas to flow through said conduit until the pressure differential across said member causes the opposing force to be less than the biasing force.

6. A pneumatic excavator as claimed in claim 1, wherein said conduit comprises:

a first sleeve and a second sleeve slidably disposed within said second sleeve;

a sealing member disposed between an outer surface of said second sleeve and an inner surface of said first sleeve; and a locking collar disposed on said first sleeve for retaining said second sleeve within said first sleeve.

7. A pneumatic excavator as claimed in claim 1, wherein said nozzle is secured to said conduit through a swivel joint.

8. A pneumatic excavator as claimed in claim 1, wherein said movable member comprises:

a manifold defining a piston receiving chamber and a bypass orifice fluidly coupled to said piston receiving chamber;

a biasing member received within said chamber; and a piston slidably received within said chamber and coacting with said biasing member, said manifold received within said conduit between said inlet end and said outlet end, whereby said biasing member urges said piston in a first position blocking said bypass orifice and thereby blocking flow through said passageway when a pressure differential across said piston is below a first value and said piston moves in a longitudinal direction within said piston receiving chamber to a second position so that said bypass orifice is in fluid communication with said piston receiving chamber and said passageway permitting gas to flow through said passageway when the pressure differential across said piston is greater than the first value.

9. A pneumatic excavator as claimed in claim 8, further comprising a bleed orifice defined at a downstream end of said manifold downstream of said bypass orifice and a seal provided between said manifold and said conduit upstream of said bypass orifice, whereby said bleed orifice is in fluid communication with a portion of said piston receiving chamber that receives said biasing member.

10. A pneumatic excavator as claimed in claim 9, further comprising:

a stop secured to said manifold and positioned within said piston receiving chamber, whereby said piston is positioned between said stop and said biasing member;

a rib attached to said manifold and extending from said manifold upstream of said bypass orifice, said rib receiving said seal; and a downstream cap secured to said downstream end of said manifold and in which said bleed orifice is defined, said biasing member being positioned between said piston and said downstream cap.

11. A pneumatic excavator as claimed in claim 10, wherein said biasing member is a spring.

12. A pneumatic excavator as claimed in claim 11, further comprising an upstream cap secured to said manifold at an upstream end of said manifold and positioned upstream of said stop, said upstream cap defining a pilot hole passing therethrough and in fluid communication with said piston receiving chamber.

13. A pneumatic excavator as claimed in claim 12, further comprising an inlet orifice defined by said manifold and positioned upstream of said bypass orifice and said rib, said piston defining a flow cavity, whereby when said piston is in the second position said inlet orifice is in fluid communication with said bypass orifice via said flow cavity so that gas can flow through said passageway and when said piston is in the first position said bypass orifice is blocked by said piston so that gas cannot flow through said passageway.

14. A pneumatic excavator as claimed in claim 8, wherein said piston comprises a body and an engaging member attached to said body and releasably secured to said manifold.

15. A pneumatic excavator as claimed in claim 14, wherein said engaging member comprises a flexible member having an engaging surface adapted to releasably engage with an inner surface of said manifold.

16. A pneumatic excavator as claimed in claim 15, wherein said inner surface of said manifold defines a pair of spaced apart recesses adapted to receive said engaging surface whereby said engaging surface is received within one of said recesses when said piston is in the first position and said engaging surface is received within the other of said recesses when said piston is in the second position.

17. A pneumatic excavator as claimed in claim 16, wherein said flexible member comprises a spring.

18. A pneumatic excavator as claimed in claim 16, further comprising a pilot valve disposed within said inlet chamber, said pilot valve having an inlet in fluid communication with said gas supply, a first outlet in fluid communication with the atmosphere and a second outlet in fluid communication with said pilot hole, whereby when said first outlet is in fluid communication with said second outlet, said pilot hole is in fluid communication with the atmosphere and gas is prevented from flowing through said pilot hole and when said inlet is in fluid communication with said second outlet, said pilot hole is in fluid communication with said inlet permitting gas to flow through said pilot hole.

19. A pneumatic excavator as claimed in claim 1, further comprising a wheeled vehicle; and a source of compressed gas provided on said vehicle, said flow conduit inlet end in fluid communication with said source of compressed gas.

20. A pneumatic excavator as claimed in claim 19, wherein said source of compressed gas is a gas compressor.

21. A pneumatic excavator as claimed in claim 19, wherein said wheeled vehicle is a power driven vehicle.

22. A pneumatic excavator as claimed in claim 19, wherein said wheeled vehicle comprises a cart having a frame, a handle attached to said frame, a wheel rotatably attached to said frame and a support attached to said frame, whereby when said cart is in a parked position said support rests on a supporting surface along with said wheel and when said handle is moved upwardly said support is lifted off the supporting surface and said cart can move on the supporting surface through rotation of said wheel.

23. A person-portable pneumatic excavator, comprising:

a flow conduit defining a passageway having an inlet end and an outlet end;

a source of pressurized gas in fluid communication with said flow conduit inlet end;

a nozzle disposed at said outlet end of said conduit; and a movable member disposed within said conduit intermediate said inlet end and said outlet end, said movable member adapted to move periodically relative to said conduit so as to periodically block flow through said passageway and pulse a gas passing through said conduit, wherein said excavator is portable by a person.

* * * * *

UNITED STATES PATENT AND TRADEMARK OFFICE

CERTIFICATE OF CORRECTION

PATENT NO. : 6,158,152
DATED : December 12, 2000
INVENTOR(S) : Richard D. Nathenson et al.

It is certified that error appears in the above-identified patent and that said Letters Patent is hereby corrected as shown below:

Column 10,
Line 19, after "so the hand tool" delete period (.).

Column 12,
Line 36, "member 183" should read -- member 188 --.

Column 13,
Line 42 "in use" should read -- In use --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*